US007665403B2

(12) United States Patent
Shimamura

(10) Patent No.: US 7,665,403 B2
(45) Date of Patent: Feb. 23, 2010

(54) CARRYING SYSTEM

(75) Inventor: Kazunori Shimamura, Inuyama (JP)

(73) Assignee: Murata Kikai Kabushiki Kaisha, Kyoto-shi (JP)

( * ) Notice: Subject to any disclaimer, the term of this patent is extended or adjusted under 35 U.S.C. 154(b) by 161 days.

(21) Appl. No.: 11/652,130

(22) Filed: Jan. 11, 2007

(65) Prior Publication Data

US 2007/0169659 A1 Jul. 26, 2007

(30) Foreign Application Priority Data

Jan. 26, 2006 (JP) ..... 2006-018123

(51) Int. Cl.
*B61B 3/00* (2006.01)

(52) U.S. Cl. ..... 104/89; 104/91

(58) Field of Classification Search ..... 104/89, 104/90, 91, 92, 93, 94, 95, 106, 107, 122, 104/148, 154, 155; 414/222.07, 222.13, 414/226.05, 265, 331.06, 339, 462, 572, 414/589

See application file for complete search history.

(56) References Cited

U.S. PATENT DOCUMENTS 4,944,230 A * 7/1990 Maeda et al. ..... 104/139
5,144,894 A * 9/1992 Scheuer ..... 104/127
5,351,621 A * 10/1994 Tanaka et al. ..... 104/94
5,355,804 A * 10/1994 Garcia et al. ..... 104/93
5,456,118 A * 10/1995 Hines et al. ..... 73/818
7,392,747 B2 * 7/2008 Ksyk ..... 104/96
2004/0107862 A1 * 6/2004 Suh ..... 104/91
2007/0039512 A1 * 2/2007 Ksyk ..... 104/89
2007/0163461 A1 * 7/2007 Shiwaku ..... 104/89
2007/0169659 A1 * 7/2007 Shimamura ..... 104/94

FOREIGN PATENT DOCUMENTS

JP 60-161664 U 10/1985
JP 2000-159101 A 6/2000
JP 2000159101 A * 6/2000

* cited by examiner

*Primary Examiner*—S. Joseph Morano
*Assistant Examiner*—Jason C Smith
(74) *Attorney, Agent, or Firm*—Westerman, Hattori, Daniels & Adrian, LLP

(57) ABSTRACT

The present invention prevents an obstacle from entering a running route of an overhead carriage to allow the carriage to run smoothly, increasing carrying efficiency. The present invention provides a carrying system including a carriage 1 having a hoist 7 that elevates and lowers an article in a vertical direction and a running portion 2, and a track 12 which internally houses the running portion 2 and which is suspended from a ceiling. The carrying system has a cover 13 placed parallel to the track 12 to prevent entry of an obstacle into the track; the cover 13 is provided below the track 12 so as not to hinder the elevation and lowering of the article executed by the hoist 7.

5 Claims, 5 Drawing Sheets

CARRYING SYSTEM

FIELD OF THE INVENTION

The present invention relates to overhead carriages that run along a track provided above a floor surface, and in particular, to construction of a carrying system for preventing collision of the carriage.

BACKGROUND OF THE INVENTION

An overhead carriage has been known which has a running portion placed inside a rail laid on the ceiling and an article placing portion provided outside the rail (see the Unexamined Japanese Utility Model Application Publication (Jikkai-sho) 60-161664). This carriage is placed so as to run at a height position where it normally does not come into contact with an operator. The carriage also has a safety device that detects an obstacle entering a running route of the carriage and stops the carriage when detecting an obstacle.

The term "running route" as used herein refers to the whole space through which the carriage passes. A space through which the running portion passes is covered with the rail, whereas a space through which the article placing portion passes is exposed to the exterior. The safety device is actuated not only when an operator crosses the running route but also when, for example, for replacement of an article processing device, an obstacle such as the processing device is transported across the running route. As such a safety device, an obstacle sensor such as a reflective optical sensor is mounted on the carriage.

An obstacle suddenly entering the running route may come into collide with the accidentally passing carriage (article placing portion), or even if the carriage is running at a position located away from the obstacle entry position, such a collision may occur when the carriage approaches the object but the breaks fail to be applied in time. Thus, when any obstacle possibly crosses the running route, the carriage is not operated. However, this may disadvantageously reduce carrying efficiency. That is, a problem to be solved by the present invention is that an exposed portion of the running route of the carriage (space through which the carriage passes) may cause an obstacle to enter the running route.

SUMMARY OF THE INVENTION

A description has been given of the problem to be solved by the present invention. Now, the description will be given of means for solving the problem.

According to a first embodiment, there is provided a carrying system comprising a carriage including a hoist that elevates and lowers an article in a vertical direction and a running portion, and a track which internally houses the running portion and which is suspended from a ceiling, the carrying system having at least one cover placed parallel to the track to prevent entry of an obstacle into the track, the cover being provided below the track so as not to hinder the elevation and lowering of the article executed by the hoist.

According to a second embodiment, the carrying system has lateral moving means for horizontally moving the hoist in a lateral direction, and the cover has an opening so as not to hinder the movement executed by the lateral moving means.

According to a third embodiment, the covers cover laterally opposite side surfaces of the article and carriage, and an inner side surface of the covers is subjected to diffused reflection-proof finish.

The present invention exerts the following effects.

According to the first embodiment, the entire running route of the carriage is covered to prevent an obstacle from entering the running route. This eliminates the need to stop the carriage in fear of entry of an obstacle into the running route. A decrease in carrying efficiency is also prevented.

According to the second embodiment, even a carriage that transfers articles not only in a vertical direction but also in a lateral direction can successfully transfer the articles.

According to the third embodiment, it is unnecessary to provide a polarizing sensor for preventing erroneous detections caused by diffused reflection. This allows the carriage to be also operated at curves.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
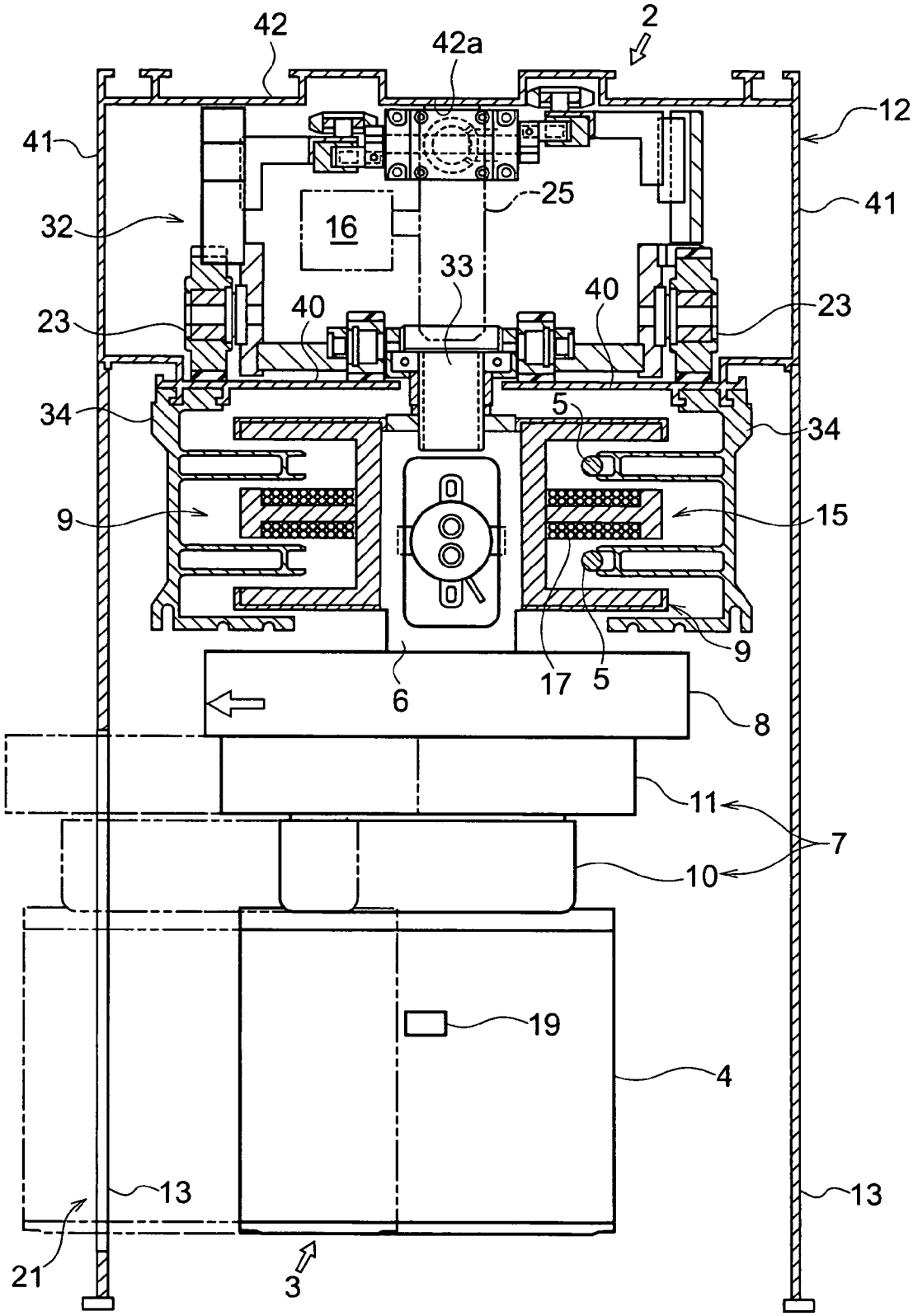
FIG. 1 is a front sectional view showing a track and a carriage.
Figure 2:
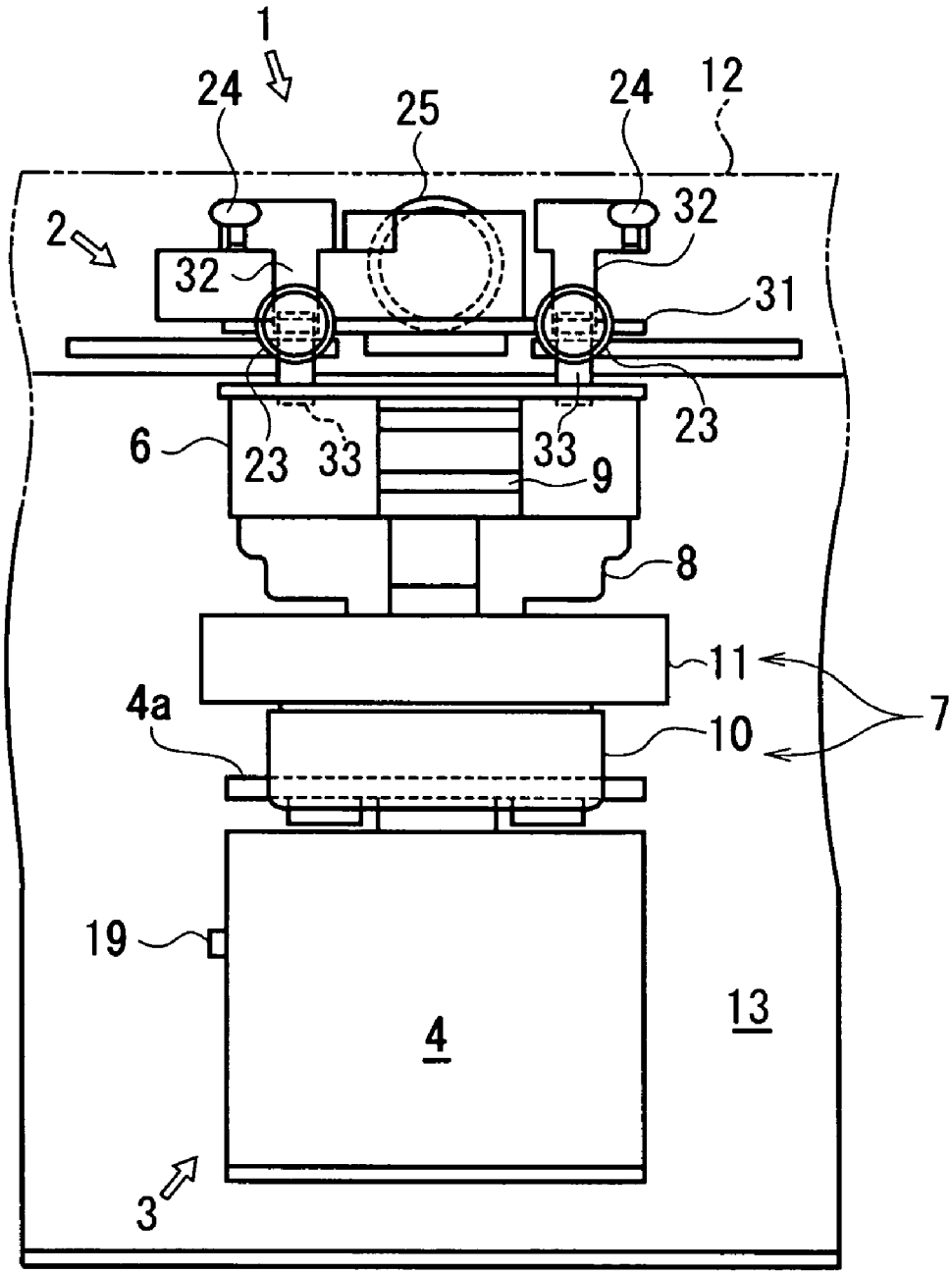
FIG. 2 is a side view showing the carriage.

With reference to FIGS. 1 to 5, a description will be given of configuration of a carrying system according to an embodiment of the present invention.

The carrying system is composed of a carriage 1, a track 12, and covers 13, 13 arranged parallel to the track 12 to prevent an obstacle from entering the track 12. A shown in FIGS. 1 and 2, the carriage 1 has a running portion 2 in its upper part and an article supporting device 3 in its lower part. The running portion 2 and the article supporting device 3 are coupled together via a coupler 6. The carriage 1 runs along the track 12 suspended from a ceiling. A feeder line holder 34 for feeding electricity to the carriage 1 and the covers 13 are fixed to the carriage 1. The running portion 2 of the carriage 1 is accommodated in the track 12. The article supporting device 3 is covered with the laterally opposite covers 13, 13 on its respective lateral sides.

Figure 3:
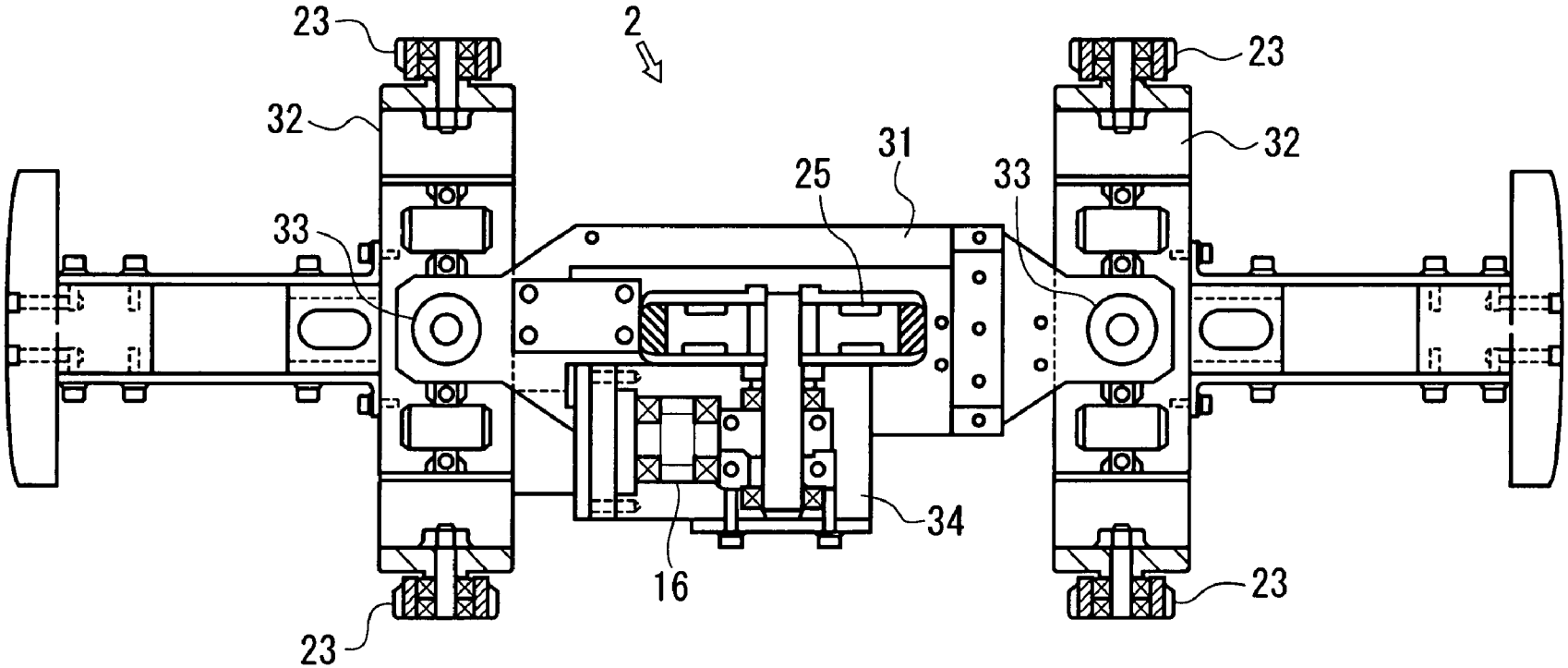
FIG. 3 is a planar sectional view showing the carriage.

As shown in FIG. 3, the running portion 2 is composed of a central main frame 31 and wheel supporting portions 32, 32 located in front of and behind the main frame 31. The wheel supporting portions 32, 32 are coupled to the main frame 31 via shafts 33, 33 so as to be freely rotatable with respect to the main frame 31. This enables the carriage 1 to run along curves formed in the track 12. The article supporting portion 3 in which an article can be loaded is provided below the running portion 2. The article supporting device 3 is supported by the running portion 2 via the coupler 6.

The running portion 2 has a motor 16 as means for driving the carriage 1 as shown in FIG. 1. The motor 16 is attached to the main frame 31. A driving wheel 25 is connected to a motor shaft of the motor 16. The driving wheel 25 is drivingly rotated by the motor 16.

The wheel supporting portion 32 has cross section shaped like the letter U that is open at the top as viewed from a running direction. Running wheels 23, 23 having lateral axles are arranged on the laterally opposite sides in a lower portion of the wheel supporting portion 32. The running wheels 23, 23 are fixed to the wheel supporting portion 32. The running wheels 23 are placed on the laterally opposite sides of each of the front and rear wheel supporting portions 32. The running portion 2 as a whole has four running wheels 23 located in its front and rear and on its laterally opposite sides. The running wheels 23, 23, . . . are in contact with running surfaces 40, 40 (described later) formed in the track 12 to support the carriage 1 on the track 12.

As shown in FIG. 1, paired pickup units 9, 9 are provided on the laterally opposite sides of the coupler 6 as means for feeding electricity to the carriage 1. Each pickup unit 9 comprises an E-shaped core 15 having an opening through which a feeder lines 5 provided below the track 12 can be inserted. By utilizing electromagnetic induction caused by magnetic fields generated by an alternating current flowing through each of the feeder lines 5, 5, a pickup coil 17 provided in the core 15 receives electricity. Each of the feeder lines 5, 5 is supported by a feeder line holder 34 provided below the track 12. The means for feeding electricity to the carriage 1 is not limited to the non-contact feeding scheme using the cores and feeder lines.

Figure 4:
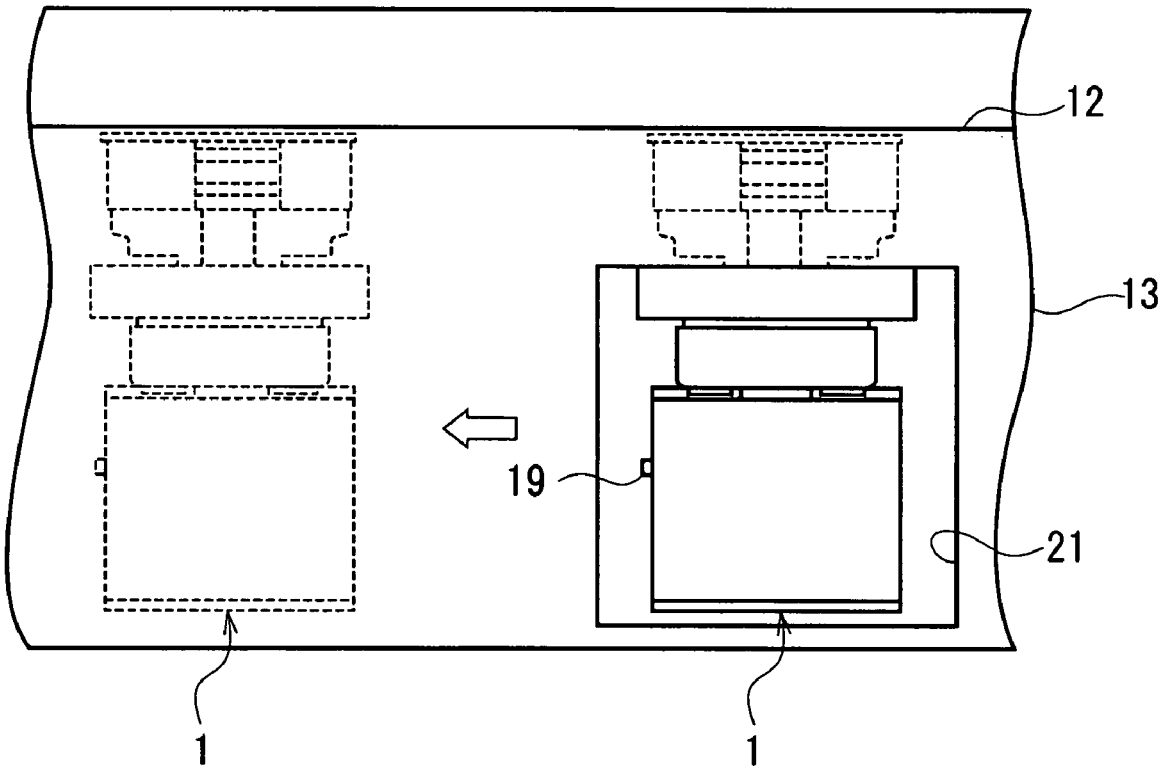
FIG. 4 is a side view showing the track and the carriage.

As shown in FIG. 4, the carriage 1 has a reflective optical sensor 19 for detecting the preceding carriage 1. The sensor 19 is attached to the front surface of the carriage 1 to detect the distance to the preceding carriage 1. The principle of detection is that light is flooded by a light emitting portion and reflected light is received so that the distance can be determined from the intensity of the received light. When the sensor 19 detects that the preceding carriage 1 is running at a short distance from the succeeding carriage 1, the succeeding carriage 1 stops. Each carriage 1 has a reflector on its rear surface to efficiently reflect light flooded by a respective succeeding carriage 1. In the present embodiment, the carriage 1 is configured to run only forward along the running route and not to run backward. Accordingly, the sensor 19 is provided only on the front surface of the carriage 1 so as to be able to detect the preceding carriage 1. When the carriage 1 is configured to run both forward and backward, the sensor 19 is also provided on the rear surface of the carriage 1.

The track 12 is provided above the floor surface, and the carriage 1 runs while being suspended from the track 12. The track 12 is composed of a base 42 having a cross section shaped like the letter U that is open at its bottom as viewed from the track direction and extending in a horizontal direction, and side walls 41, 41 extending downward from the opposite ends of the base 42. A horizontal portion is also extended inward from the lower ends of the side walls 41, 41 and has a top surface formed into a running surface 40 contacted by the running wheels 23. The bottom surface of a lateral center portion of the base 42 is formed into a running surface 42*a* contacted by the driving wheel 25.

Paired guide wheels 24, 24 having vertical axles are provided on the laterally opposite sides of top of each wheel supporting portion 32. The right and left guide wheels 24, 24, . . . are almost in contact with the side walls 41, 41 formed on the track 12. This allows the carriage 1 to run along the track 12 without shifting in the lateral direction.

Next, the configuration of the article supporting device 3 will be described. The article supporting device 3 has a hoist 7 that suspends an article 4, and lateral moving means 8 for enabling the hoist 7 to be moved in the lateral direction with respect to the track direction. The hoist 7 is placed below the lateral moving means 8. The covers 13 cover laterally opposite sides of the article supporting device 3.

The lateral moving means 8 is composed of lateral moving rails and a lateral feeding mechanism. The hoist 7 is supported by its upper part being sandwiched between the lateral moving rails. The lateral moving mechanism operates to move the hoist 7 along the lateral moving rails.

The hoist 7 is composed of a chuck mechanism 10 and a winch 11 that is means for elevating and lowering the chuck mechanism 10. The chuck mechanism 10 is placed below the winch 11. The tip of a wire (not shown in the drawings) is attached to the chuck mechanism 10. Winding or winding back the wire enables the chuck mechanism 10 to be elevated or lowered.

The article 4 has a handle 4*a* at its upper end which is gripped by the chuck mechanism 10 to support the article 4. The handle 4*a* is T-shaped as viewed from the horizontal direction.

On the other hand, the chuck mechanism 10 is capable of supporting a horizontal portion of the T-shaped handle 4*a*. The chuck mechanism 10 supports the handle 4*a* provided on the top of the article 4. Then, the winch 11 and the horizontal moving means 8 drivingly lift the article 4 to a maximum extent to house the article 4 between the covers 13. When the winch 11 raises the chuck mechanism 10 supporting the article 4 to its highest position, the article 4 is housed in the article supporting device 3.

The hoist 7 can also be drivingly moved perpendicular to the track 12 by the lateral moving means 8. This allows the hoist 7 to transfer to a position other than the one immediately below the track 12.

Next, a detailed description will be given of the covers 13, 13 surrounding the article supporting device 3. The covers 13, 13 are arranged below and parallel to the track 12 to cover the carriage 1 and the article 4 suspended by the hoist 7, at the laterally opposite side surfaces of the carriage 1. The covers 13, 13 extend downward from the lower end of the side walls 41, 41 of the track 12 so as to be flush with the side walls 41, 41. The covers 13, 13 do not hinder the article 4 from being elevated or lowered. The covers 13, 13 provided on the track 12 eliminate a member for suspending the covers 13, 13 from the ceiling. This allows the covers 13, 13 to be easily provided along the track 12. Since the covers 13, 13 are provided flush with the side walls 41, 41, steps are prevented from being created at joints between the covers 13, 13 and the side walls 41, 41. Thus, when the carrying system is installed in a clean room, down flows from the ceiling can be prevented from being disturbed.

As shown in FIG. 1, the covers 13 have an openings 21 that are open toward the lateral moving route so as not to hinder the hoist 7 from being moved by the lateral moving means 8. That is, since the openings 21, 21, . . . are appropriately formed at positions where transfer operations are performed, a route is established along which the article supporting device 3 is moved by the horizontal moving means 8. This enables the article 4 to be smoothly moved.

An inner side surface of each of the covers 13 is subjected to diffused reflection-proof finish. Specifically, the inner side surface of the covers 13 is subjected to matte black coating to prevent light flooded by the sensor 19 from being diffusely reflected. Various devices such as processing devices for processing the article 4 are arranged by the side of the track 12. Accordingly, light flooded by the sensor 19 is reflected by the outer surfaces of these devices, and the reflected light may be erroneously detected by the sensor 19 of the carriage 1. Thus, by providing the covers 13, it is possible to prevent detection errors in the sensor 19 caused by flood light diffusely reflected by peripheral objects.

The detection by the reflective sensor 19 is effective in detecting the preceding carriage 1 in a straight part of the running route. However, it is difficult to detect the preceding carriage 1 in a curved part of the running route. However, by providing a mirror or the like inside the covers 13 to refract flooded and reflected light, it is possible for the sensor 19 to detect the preceding carriage 1 even in a curved part.

Figure 5:
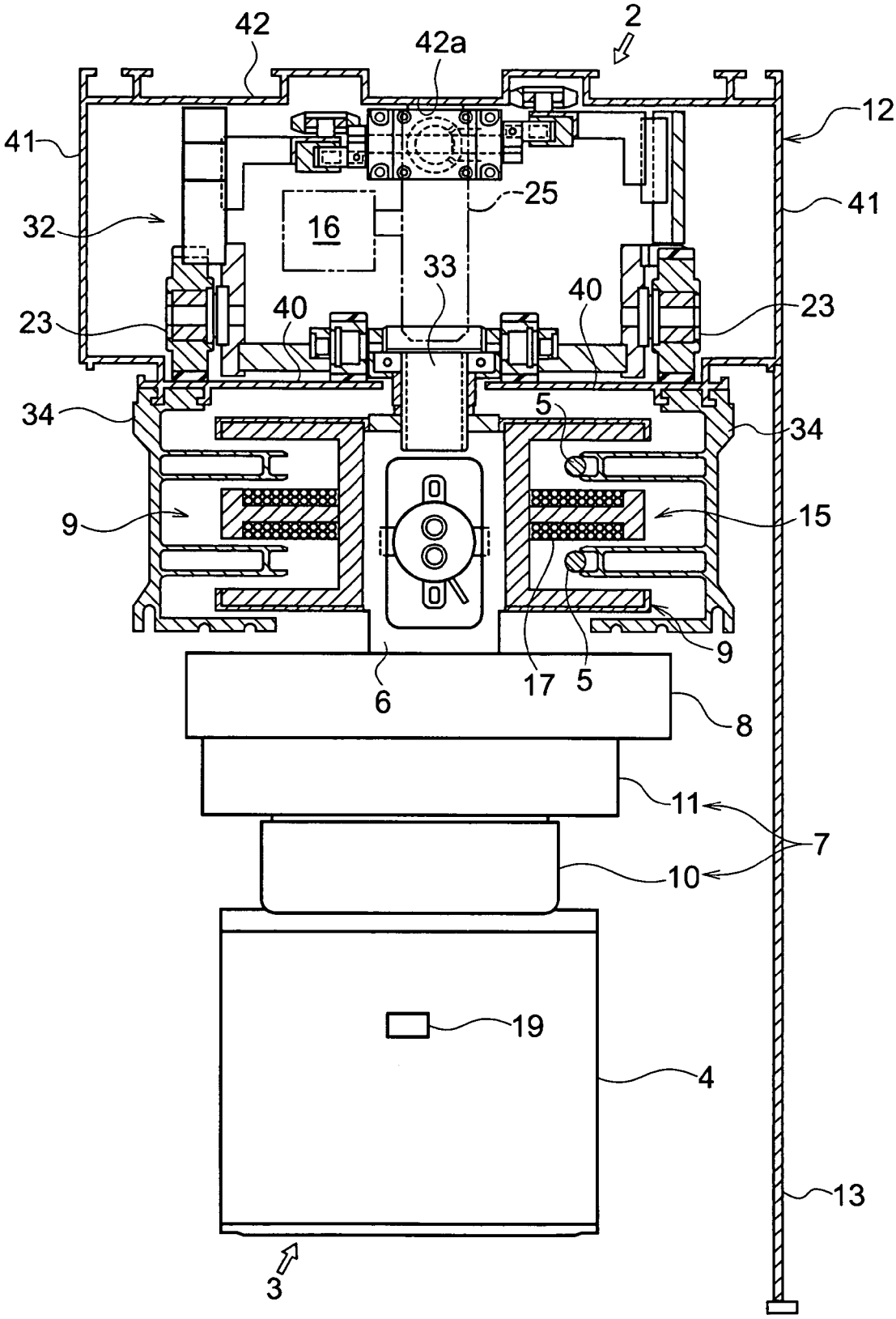
FIG. 5 is a front sectional view showing the carriage with a cover provided on only one of laterally opposite sides thereof.

The covers 13 are not required to cover all of the laterally opposite side surfaces of the carriage 1 and the article 4 lifted by the hoist 7. For example, when one of the laterally opposite sides faces a wall of a building, the cover 13 may be provided on only one of the laterally opposite sides through which an obstacle may enter the running route. As shown in FIG. 5, the carriage 1 can also be kept safe by providing the cover 13 on only one of the laterally opposite sides of the carriage 1, that is, the side located opposite the wall and on which the carriage 1 may come into collide with an operator (side on which high-place work may be performed). The covers 13 may be formed of a mesh instead of a plate. In short, it is only necessary to protect the whole space through which the carriage 1 and the article 4 supported by the carriage 1 entirely pass, that is, the running route of the carriage 1, from the entry of an obstacle. That is, the covers 13 make the space inside the covers 13 independent of the other spaces. Further, the covers 13 in the present embodiment are placed below the track 12. However, the covers 13 may be suspended from the ceiling. The position to which the covers 13 are mounted is not limited.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the invention.

The invention claimed is:

1. A carrying system, comprising:

a carriage including a hoist that elevates and lowers an article in a vertical direction, a running portion and a lateral moving means for horizontally moving the hoist in a lateral direction perpendicular to a moving direction of the carriage, a track which internally houses the running portion and which is suspended from a ceiling, and at least one cover placed parallel to the track to prevent entry of an obstacle into the track, said at least one cover being provided below the track so as to allow the elevation and lowering of the article executed by the hoist, wherein said at least one cover has an opening so as to allow horizontal movement of said hoist to a position at least partially outside said at least one cover executed by the lateral moving means.

2. The carrying system according to claim 1, wherein said system includes two covers, said two covers covering laterally opposite side surfaces of the article and the carriage, and wherein inner side surfaces of said two covers are subjected to a diffused reflection-proof finish.

3. The carrying system according to claim 2, wherein said diffused reflection-proof finish is a matte black coating.

4. The carrying system according to claim 1, wherein said carriage further comprises a reflective optical sensor on a front surface thereof.

5. The carrying system according to claim 4, wherein said carriage further comprises a reflector on a rear surface thereof.

* * * * *